US006257409B1

(12) United States Patent
Lin

(10) Patent No.: US 6,257,409 B1
(45) Date of Patent: Jul. 10, 2001

(54) POSITIVE ATTACHMENT WRENCH CASE

(76) Inventor: Su-Chen Lin, No. 130-1, Bu-Tzi Lane, Pei-Tung D.C., Taichung (TW)

( * ) Notice: Subject to any disclaimer, the term of this patent is extended or adjusted under 35 U.S.C. 154(b) by 0 days.

(21) Appl. No.: 09/545,957

(22) Filed: Apr. 10, 2000

(51) Int. Cl.[7] ..... B65D 85/20; A47F 7/00

(52) U.S. Cl. ..... 206/376; 206/483; 206/565; 211/70.6

(58) Field of Search ..... 206/376, 372, 206/370, 349, 483, 565; 211/70.6

(56) References Cited

U.S. PATENT DOCUMENTS 4,911,297 * 3/1990 Suburu ..... 206/376
4,997,085 * 3/1991 Brennan ..... 206/376

FOREIGN PATENT DOCUMENTS

2607941 * 9/1977 (DE) ..... 206/372
559167A1 * 9/1993 (EP) ..... 206/372

* cited by examiner

*Primary Examiner*—Bryon P. Gehman
(74) *Attorney, Agent, or Firm*—William E. Pelton, Esq.

(57) ABSTRACT

A positive attachment wrench case is disclosed, which has positive attachment devices defined in the case. Each positive attachment device (30) is defined to correspond to a clamp (20); and each positive attachment device (30) comprises a strip with one end attached to the case (10) and a tube (35) corresponding to the strip. A wrench (40) to be received in the clamp (20) can be locked by the strip that bends to lock into the tube (35).

5 Claims, 4 Drawing Sheets

POSITIVE ATTACHMENT WRENCH CASE

BACKGROUND OF THE INVENTION

1. Field of the Invention

The present invention relates to a wrench case and, more particularly, to a positive attachment wrench case that will prevent wrenches from shaking out of their individual holders when being transported.

2. Description of Related Art

With reference to FIG. 5, the conventional wrench case (50) comprises an open window (51), hanging openings (52) and a series of clamps (60).

The open window (51) is defined to facilitate the detachment of the wrenches received in the wrench case (50); and the hanging openings (52) allow the wrench case (50) to be hung on a display case or a workshop pegboard.

Each clamp (60) essentially comprises two opposed sides. A locking lip (62) extends horizontally along the top edge of each side, and an angular face (61) extends outward and upward from the top of each side. A head support (64) is provided in the wrench case (50) to fit into and hold the closed head on one end of a wrench received in the case.

However, wrenches may easily detach from the clamp (60) in the conventional wrench case, especially, when the wrench case is shaken when being transported.

Therefore, there is still a need for a positive attachment wrench case that will prevent the wrenches from being shaken out of the clamps when being transported.

SUMMARY OF THE INVENTION

The objective of the present invention is to provide a positive attachment wrench case that will prevent the wrenches from shaking loose during transportation.

To achieve the objective, the positive attachment wrench case in accordance with the present invention comprises at least a positive attachment device.

Other objectives, advantages, and novel features of the invention will become more apparent from the following detailed description when taken in conjunction with the accompanying drawings.

DETAILED DESCRIPTION OF THE PREFERRED EMBODIMENT

Figure 1:
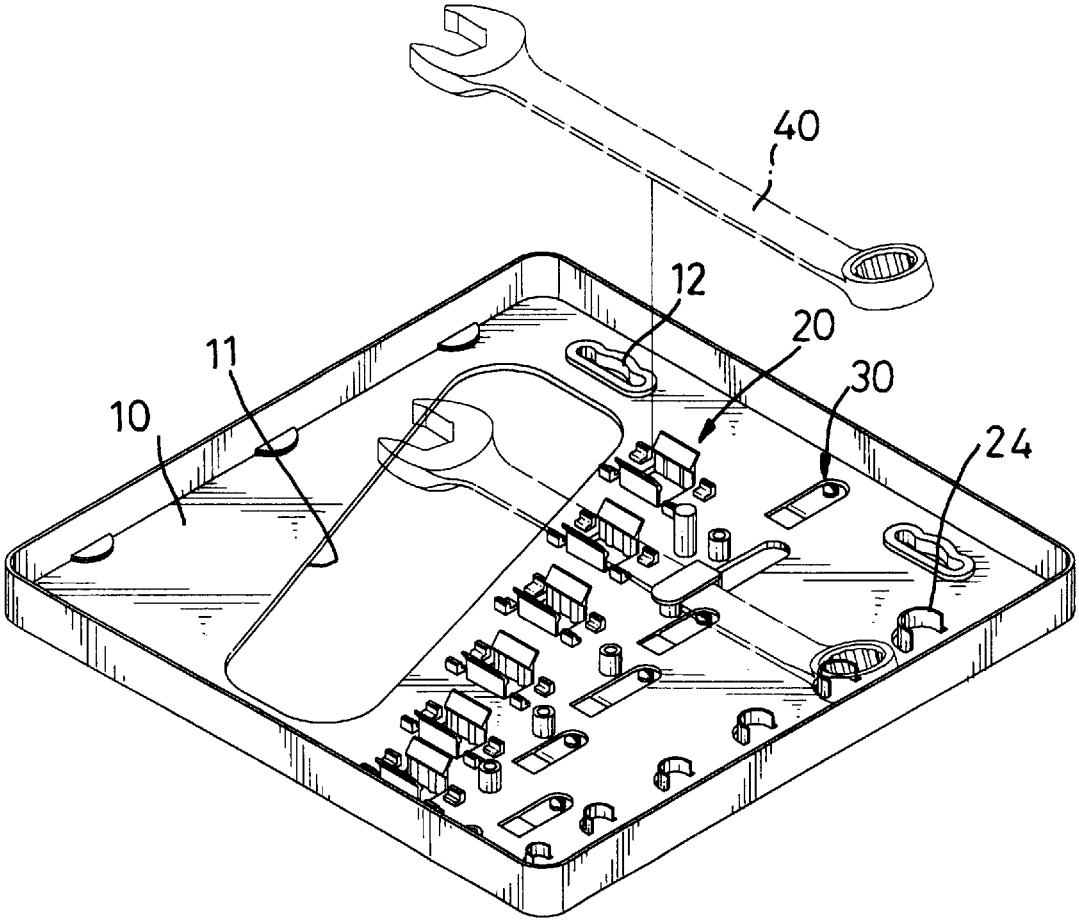
FIG. 1 is a perspective view of the positive attachment wrench case in accordance with the present invention.
Figure 2:
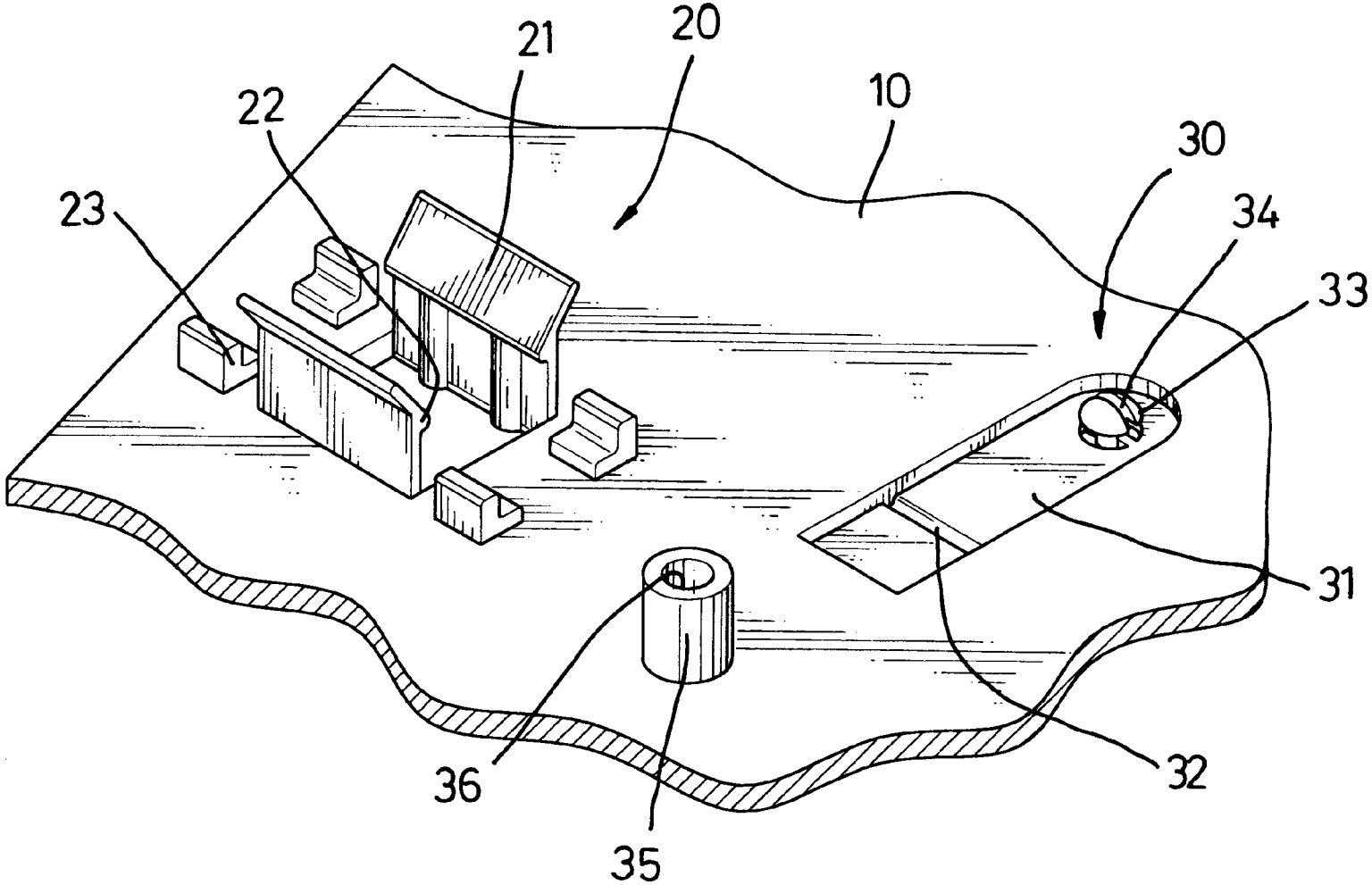
FIG. 2 is an enlarged perspective view of the positive attachment assembly in the wrench case in FIG. 1.

With reference to FIGS. 1 and 2, the positive attachment wrench case (10) in accordance with the present invention comprises a series of clamps (20) and a series of positive attachment devices (30).

The case (10) in accordance with the present invention further comprises an open window (11) to facilitate placing wrenches in the case and detaching the wrench; and hanging openings (12) to facilitate hanging the case (10) up. A head support (24) is further provided in the wrench case (10) to fit into and hold the closed head on one end of the wrench received in the case.

Each clamp (20) essentially comprises two perpendicular walls with a locking lip (22) extending in from the top of each perpendicular wall, and an angular face (21) extending up and out the top of the perpendicular wall. The shank of a wrench can be held in the clamp (20) with one end of the wrench abutting the head support (24). Two pairs of the supporting blocks (23) can be further provided on each end of each clamp (20) to support the wrench (40) received in the clamp (20).

Each positive attachment device (30) is defined to correspond to a clamp (20); and each positive attachment device (30) comprises a strip with one end pivotally attached to the case (10) and a tube (35) corresponding to the strip.

The strip of the positive attachment device (30) comprises a locking strap (31), a groove (32) and a locking protrusion (33). The groove (32) defined near one end of the locking strap (31) to allow the locking strap (31) to pivot at the groove (32). The locking protrusion (33) is defined near the other end of the locking strap (31). A slot (34) is defined through each locking protrusion (33).

Each tube (35) is defined to correspond to the strip of the positive attachment device (30); and has a locking hole (36) defined to correspond to the locking protrusion (33).

With this configuration, the positive attachment device (30) strip can be bent at the groove (32) and the locking protrusion (33) can be pressed into the locking hole (36) of the tube (35).

Figure 3:
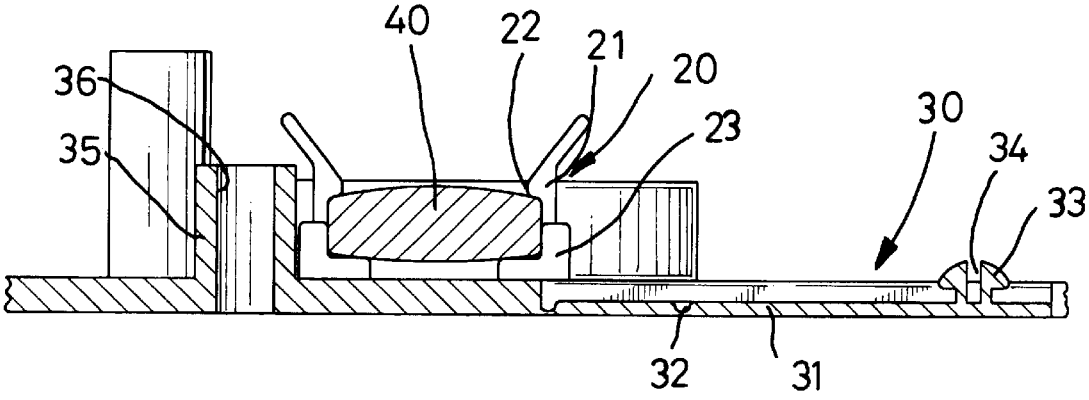
FIG. 3 is an enlarged side plan view in partial section of the positive attachment wrench case in FIG. 1.
Figure 4:
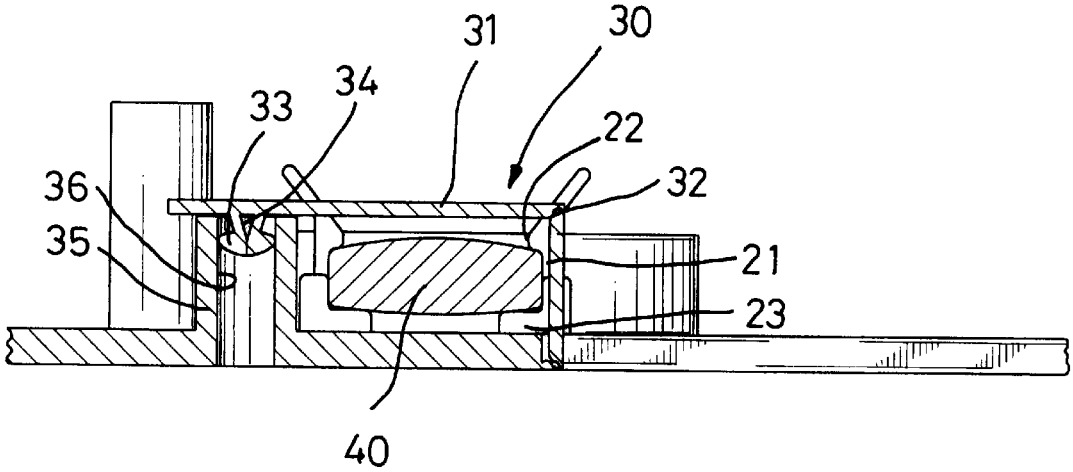
FIG. 4 is an operational side plan view in partial section of the positive attachment wrench case in FIG. 1.
Figure 5:
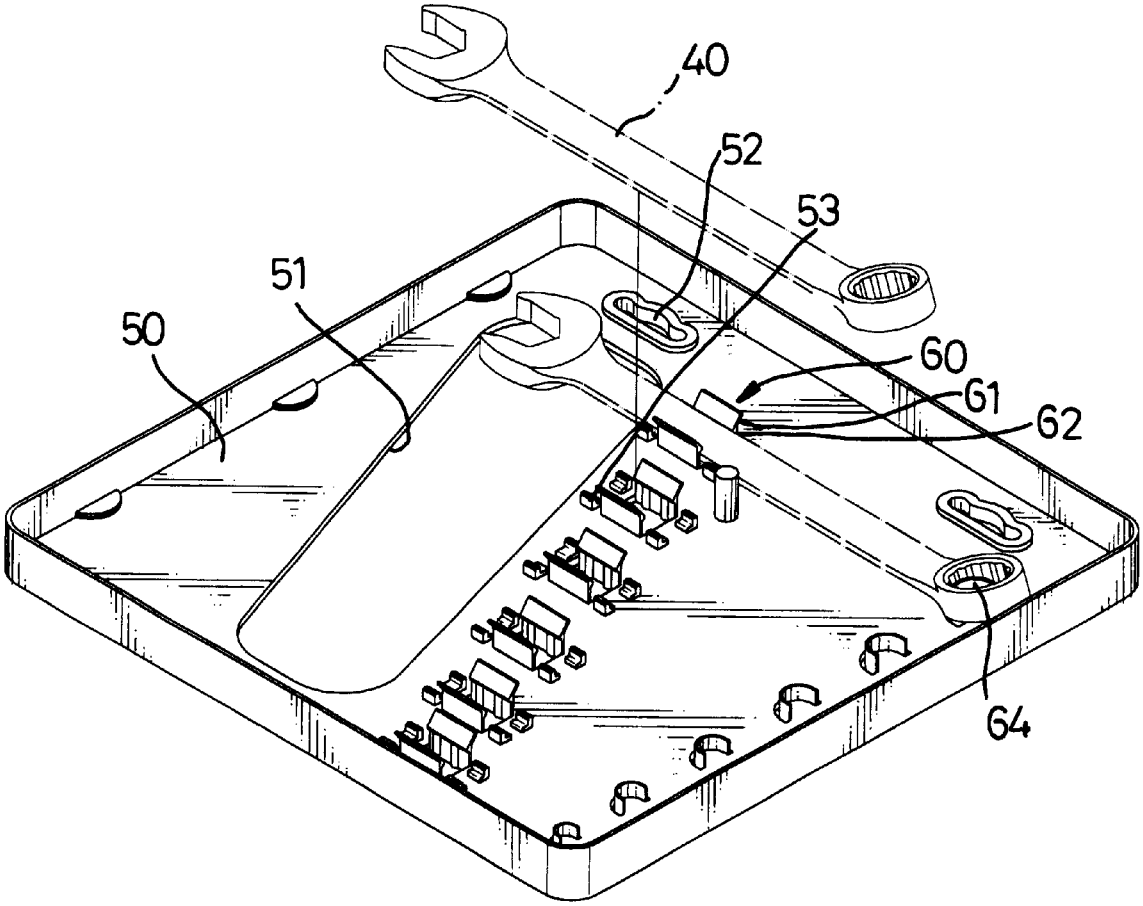
FIG. 5 PRIOR ART
FIG. 5 is a perspective view of a conventional wrench case.

With reference to FIGS. 1, 3 and 4 a wrench (40) can be received in the clamp (20) with one end of the wrench (40) abutting the head support (24) and the shank supported by two pairs of supporting blocks (23). Then, the positive attachment device (30) strip can be bent at the groove (32) so the locking protrusion (33) can be locked into the locking hole (36) of the tube (35). In this configuration, the locking strap (31) locks the shank of the wrench (40) so that the wrench (40) is prevented from detaching from the clamp (20) no matter whether the case (10) is shaken or not.

Although the present invention has been explained in relation to its preferred embodiment, it is to be understood that many other possible modifications and variations can be made without departing from the spirit and scope of the invention as hereinafter claimed.

What is claimed is:

1. A positive attachment wrench case (10) comprising a series of clamps (20) and a series of positive attachment devices (30) respectively defined thereon, wherein each positive attachment device (30) is defined to correspond to a clamp (20), and comprises:

a strip with one end attached to the case (10) and comprising a locking strap (31), a groove (32) defined near one end of the locking strap (31) such that the locking strap (31) pivots at the groove (32), and a locking protrusion (33) defined on the other end of the locking strap (31) with a slot (34) defined therethrough; and a tube (35) corresponding to the strip and comprising a locking hole (36) defined to correspond to the locking protrusion (33).

2. The positive attachment wrench case (10) as claimed in claim 1, wherein two pairs of the supporting blocks (23) are further provided on each end of each clamp (20) to support a wrench (40) to be received in the clamp (20).

3. The positive attachment wrench case (10) as claimed in claim 1, wherein each clamp (20) essentially comprises two perpendicular walls each with a locking lip (22) extending in from the top, and an angular face (21) extending up and out from the top of the perpendicular wall.

4. The positive attachment wrench case (10) as claimed in claim 1, wherein a head support (24) is provided to correspond to each clamp (20) to support one end of a wrench (40) received in the clamp (20).

5. The positive attachment wrench case (10) as claimed in claim 1, wherein the case (10) further comprises an open window (11) and hanging openings (12).

* * * * *